US010046340B2

(12) United States Patent
Lin et al.

(10) Patent No.: US 10,046,340 B2
(45) **Date of Patent: *Aug. 14, 2018**

(54) COMBINATION SHOWERHEAD WITH ROTARY BUTTON SWITCHING

(71) Applicants: XIAMEN SOLEX HIGH-TECH INDUSTRIES CO., LTD., Xiamen, Fujian (CN); Huasong Zhou, Fujian (CN)

(72) Inventors: Fengde Lin, Fujian (CN); Mingfu Zhang, Fujian (CN); Xi Huang, Fujian (CN)

(73) Assignee: XIAMEN SOLEX HIGH-TECH INDUSTRIES CO., LTD., Xiamen, P.R. (CN)

( * ) Notice: Subject to any disclaimer, the term of this patent is extended or adjusted under 35 U.S.C. 154(b) by 0 days.

This patent is subject to a terminal disclaimer.

(21) Appl. No.: 15/353,378

(22) Filed: Nov. 16, 2016

(65) Prior Publication Data

US 2017/0165686 A1 Jun. 15, 2017

(30) Foreign Application Priority Data

Dec. 15, 2015 (CN) ..... 2015 1 0934748

(51) Int. Cl.
*B05B 1/16* (2006.01)
*B05B 1/18* (2006.01)
(Continued)

(52) U.S. Cl.
CPC ..... *B05B 1/18* (2013.01); *B05B 1/1636* (2013.01); *B05B 1/1681* (2013.01); *B05B 15/63* (2018.02);
(Continued)

(58) Field of Classification Search
CPC ... B05B 1/1627; B05B 1/1636; B05B 1/1645; B05B 1/1654; B05B 1/18; B05B 1/185;
(Continued)

(56) References Cited

U.S. PATENT DOCUMENTS

2008/0295242 A1* 12/2008 Tsai ..... B05B 1/18 4/615
2009/0007330 A1* 1/2009 Genord ..... B05B 1/16 4/695
(Continued)

FOREIGN PATENT DOCUMENTS

CN 103521369 A 1/2014

*Primary Examiner* — Darren W Gorman
(74) *Attorney, Agent, or Firm* — Rabin & Berdo, P.C.

(57) ABSTRACT

A combination showerhead with rotary button switching includes a fixing holder mounted to a supporting arm and having an inlet passage and at least two diversion passages; a first showerhead mounted to the fixing holder and connected to at least one diversion passage; a second showerhead connected to another diversion passage; and a switching mechanism including a diversion plate configured to rotatably connect to the fixing holder and to cooperate with the inlet passage and the at least two diversion passages to switch waterways; a rotary button configured to rotatably connect to the fixing holder; and a transmission mechanism connected between the diversion plate and the rotary button to control position of the diversion plate, and that includes a first gear connected to the diversion plate and a second gear connected to the rotary button, the first gear and the second gear being engaged with one another.

10 Claims, 12 Drawing Sheets

(51) Int. Cl.

| | |
|---|---|
| ***B05B 15/06*** | (2006.01) |
| ***B05B 15/08*** | (2006.01) |
| ***E03C 1/04*** | (2006.01) |
| ***E03C 1/06*** | (2006.01) |
| ***B05B 15/65*** | (2018.01) |
| ***B05B 15/63*** | (2018.01) |
| *B05B 15/654* | (2018.01) |

(52) U.S. Cl.
CPC ..... *B05B 15/65* (2018.02); *E03C 1/0408* (2013.01); *E03C 1/0409* (2013.01); *E03C 1/06* (2013.01); *B05B 15/654* (2018.02); *E03C 1/0405* (2013.01)

(58) Field of Classification Search
CPC ... B05B 15/061; B05B 15/065; E03C 1/0405; E03C 1/0408; E03C 1/0409; E03C 1/06
See application file for complete search history.

(56) References Cited

U.S. PATENT DOCUMENTS

2010/0180376 A1* 7/2010 Deng ..... E03C 1/0408 4/695
2010/0180967 A1* 7/2010 Deng ..... E03C 1/0408 137/625
2010/0213282 A1* 8/2010 Peel ..... B05B 1/1654 239/390
2014/0054398 A1* 2/2014 Lev ..... B05B 1/185 239/443
2015/0090812 A1* 4/2015 Wu ..... E03C 1/0409 239/446
2015/0115064 A1* 4/2015 Wu ..... B05B 1/185 239/443
2015/0360243 A1* 12/2015 Soetaert ..... B05B 1/18 4/615

* cited by examiner

COMBINATION SHOWERHEAD WITH ROTARY BUTTON SWITCHING

FIELD OF THE INVENTION

The present invention relates to combination showerhead, and especially to a combination showerhead with rotary button switching.

BACKGROUND OF THE INVENTION

The existing combination showerhead, as Chinese patent No. 103521369A disclosed, is a shower system comprising a top-spray showerhead with at least two spray types and a handle showerhead, and the top-spray showerhead is disposed with an inlet passage for water supply and first diversion passages corresponding to spray types; the top-spray showerhead is disposed with a second diversion passage connected to the handle showerhead by a hose; a switching mechanism disposed on the top-spray showerhead is capable of switching waterway by cooperating with the inlet, first passages and second passages, thereby any of the diversion passage could be selected to connect with the inlet, however, the structure is not compact enough and needs further improvement.

SUMMARY OF THE INVENTION

The objective of present invention is to provide combination showerhead with rotary button switching, which overcome the disadvantages of the existing technology.

The technical proposal of the present invention is that:

A combination showerhead with rotary button switching comprises: a fixing holder (10) mounted to supporting arm (70), a first showerhead (20) mounted to the fixing holder (10), a second showerhead (30) and a switching mechanism (40), the fixing holder (10) comprises an inlet passage (11) connected to the supporting arm (1) and at least two diversion passages (12) of which one is connected to the second showerhead (30) and others are connected to the first showerhead (20);

wherein the switching mechanism (40) comprises:

a diversion plate (41), which is capable of being rotatably connected to the fixing holder (10) and cooperated with the inlet passage (11) and the diversion passages (12) to switching waterway;

a rotary button (42), which is capable of being rotatably connected to the fixing holder (10) for user's operation; and a transmission mechanism, which is connected between the diversion plate (41) and the rotary button (42) in transmission way.

In one preferred embodiment, the transmission mechanism comprises a first gear (43) connected to the diversion plate (41) in transmission way and a second gear (44) connected to the rotary button (42) in transmission way, and the first gear (43) and the second gear (44) are engaged.

In another preferred embodiment, both of the first gear (43) and the second gear (44) is bevel gear and rotation axes of the diversion plate (41) and the rotary button (42) intersect each other.

In another preferred embodiment, the the switching mechanism (40) further comprises an elastomer (46) abuts against between the diversion plate (41) and the fixing holder (10); a shaft (45) is fixed below the diversion plate (41), the first gear (43) is fixed to the shaft (45); a fixing rod is fixed on the back of the rotary button (42) and the second gear (44) is fixed to the fixing rod.

In another preferred embodiment, front of the diversion plate (41) is convexly disposed with a connecting column (411), the rotary button (42) is convexly disposed with a connecting seat (423), and the connecting column (411) and the connecting seat (423) are in demountable connection.

In another preferred embodiment, back of the fixing holder (10) is convexly disposed with a assembly portion (13) and the switching mechanism (40) is disposed inside the assembly portion (13) with at least part of the rotary button (43) locates outside for user's operation.

In another preferred embodiment, the second showerhead (30) is handle showerhead; the outlet of the diversion passages (12) connected to the second showerhead (30) is disposed on the sidewall of the assembly portion (13), and the handle showerhead is connected to corresponding outlet through a flexible hose (50), front lower part of the fixing holder (10) is disposed with a connecting portion (14) for handle showerhead positioning.

In another preferred embodiment, the second showerhead (30) is fixed showerhead fixed on the front lower part of the fixing holder (10).

In another preferred embodiment, the fixing holder (10) has a common portion (15) and two forking portion (16) forking extend from the common portion (15), the first showerhead (20) is rotatably connected between the two forking portion (16); a hose piece (21) is disposed along the rotation axis of the first showerhead (20) and part of the diversion passage (12) is connected to the first showerhead (20) along the hose piece (21).

In another preferred embodiment, the assembly portion (13) is disposed on back of the common portion (15).

In another preferred embodiment, a damping mechanism (60) is disposed between one forking portion (16) of the fixing holder (10) and the first showerhead (20).

In another preferred embodiment, the damping mechanism (60) comprises a locating holder (61), a turning block (62) and a cam (63), at least two dangling pieces (64) disposed separately in circumferential direction on the locating holder (61) form a rotary sleeve-like structure with at least part of the inner wall being of radii changing, the cam (63) is disposed in the rotary sleeve to match the radii changing part, the turning block (62) is sleeved on the rotary sleeve, friction force of the dangling pieces (64) and the turning block (62) changes with rotation of the cam (63) relative to the radii changing part and thereby the damping changes.

In another preferred embodiment, the fixing holder (10) has a common portion (15) and the first showerhead (20) is rotatably connected to the common portion (15); at least a hose piece (21) is disposed along the rotation axis of the first showerhead (20) and part of the diversion passage (12) is connected to the first showerhead (20) along the hose piece (21).

Comparing to the existing technology, the present invention has advantages as follows:

1. The switching mechanism is disposed on fixing holder; the first showerhead could be new design or existing one; the rotation of rotary button drives diversion plate to rotate through gear transmission, thereby the switching is realized; The switching with rotary button driving is novel and convenient for one-handed operation, which is of reasonable layout, compact structure and easy switching.

2. Gear is applied in waterway switching of showerhead; since the arrangement of the gears' axes is relatively free, position and direction of rotary button and diversion plate could be arranged according to structure requirement of fixing holder, which is of reasonable layout, compact structure and easy operation since rotation angle and force can be adjusted by gears.

3. Both of the first gear and the second gear are bevel gears and rotation axes of diversion plate and rotary button intersect each other, which is of reasonable layout and compact structure.

4. Front of diversion plate is convexly disposed with connecting column, rotary button is convexly disposed with connecting seat, and connecting column and connecting seat are in demountable connection, which is east assembly with simple and compact structure.

5. Back of the fixing holder is convexly disposed with a assembly portion and the switching mechanism is disposed inside the assembly portion, part of rotary button locates outside for user's operation, which is of reasonable layout, compact structure, good-looking appearance and easy operation.

6. A connecting portion for handle showerhead positioning is disposed on the front lower part of the fixing holder, which facilitates user to take down or lay up with good-looking appearance.

7. The fixing holder has common portion and forking portions, the first showerhead is rotatably connected between the two forking portions; since the first showerhead is rotatable, user can adjust the angle of water flowing according to needs, which is convenient.

8. Damping mechanism is disposed between forking portion of fixing holder and the first showerhead so that the first showerhead could be positioned in a certain angle.

9. With rotation of the cam relative to the radii changing part, friction force of the dangling pieces and the turning block changes and thereby the damping changes, which is of simple and compact structure and easy to use.

BRIEF DESCRIPTION OF THE DRAWINGS

The present invention will be further described with the drawings and the embodiments.

DETAILED DESCRIPTION OF THE EMBODIMENTS

Figure 1:
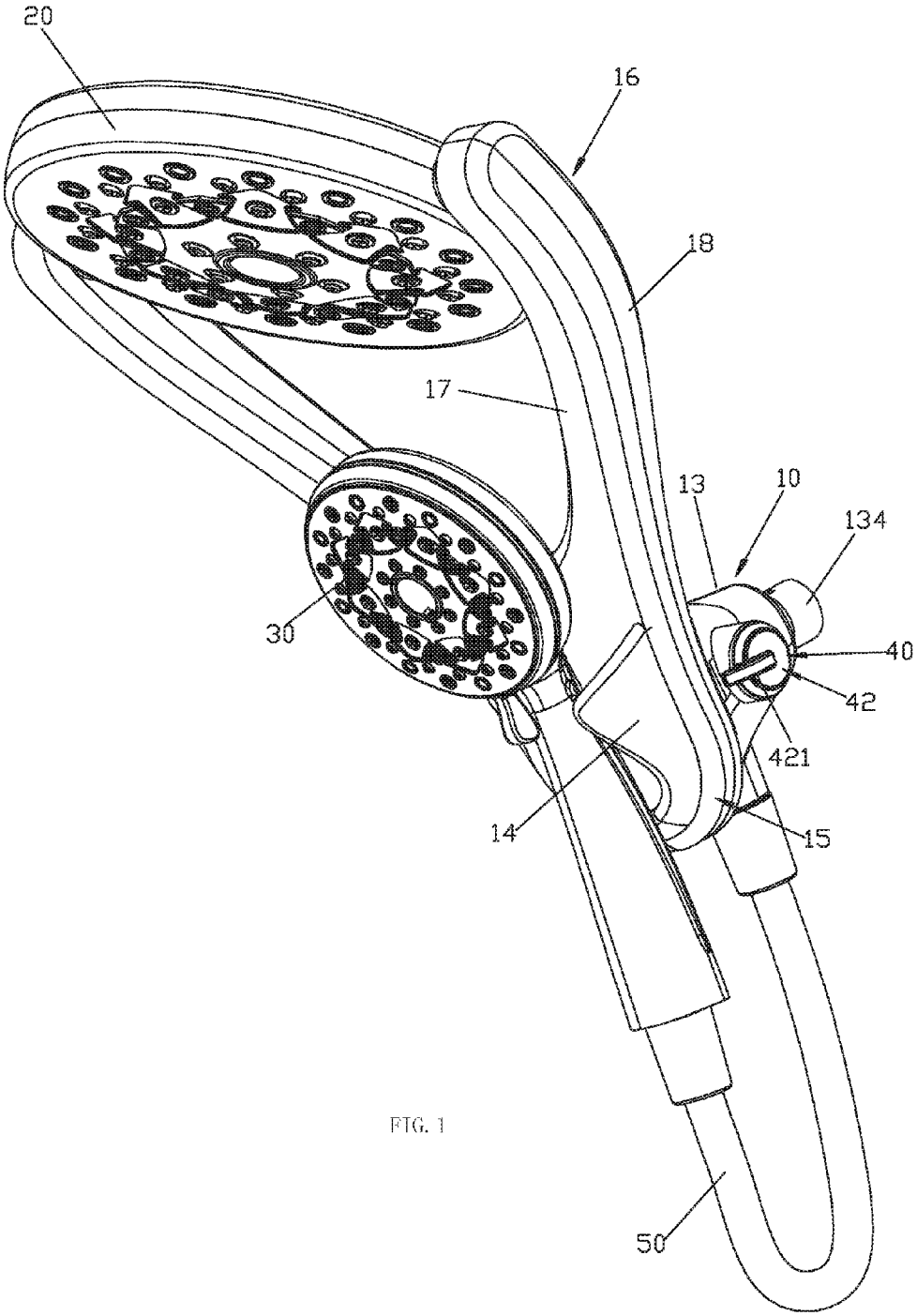
FIG. 1 illustrates a perspective schematic diagram of the combination showerhead of a preferred embodiment.
Figures 2, 3:
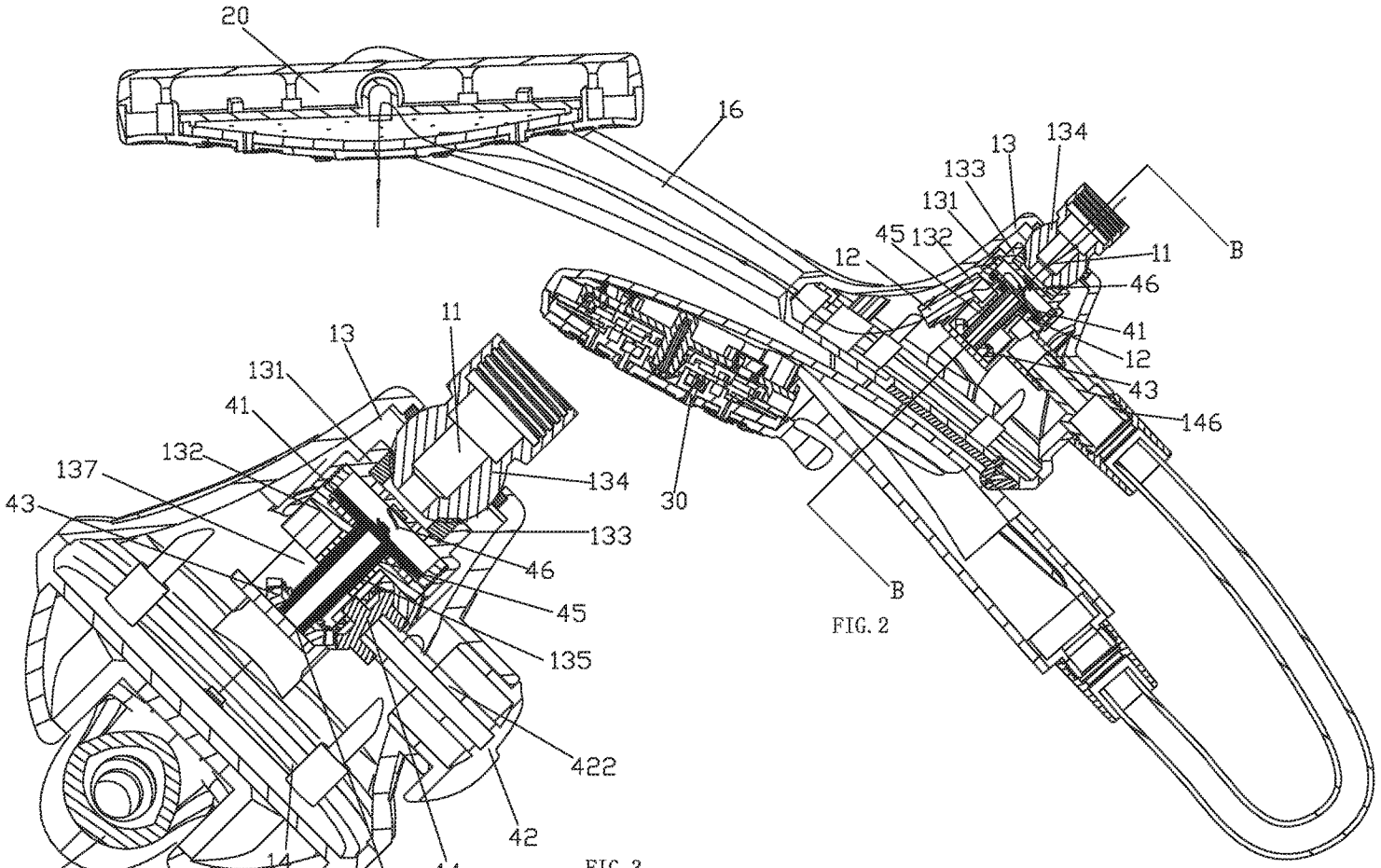
FIG. 2 illustrates a cross-section schematic diagram of the combination showerhead of a preferred embodiment under condition that water flows from the first showerhead.
FIG. 3 illustrates a B-B cross-section schematic diagram of the combination showerhead of FIG. 2.
Figure 4:
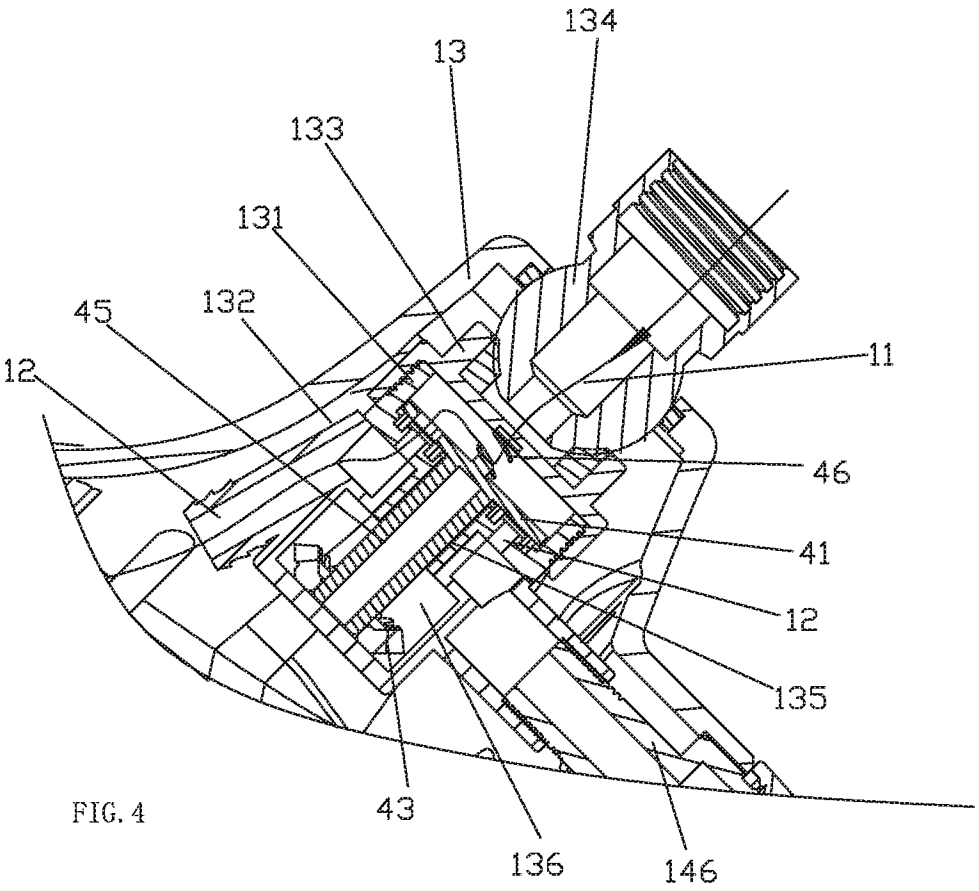
FIG. 4 illustrates a local enlarged schematic diagram of the combination showerhead of FIG. 2.
Figure 5:
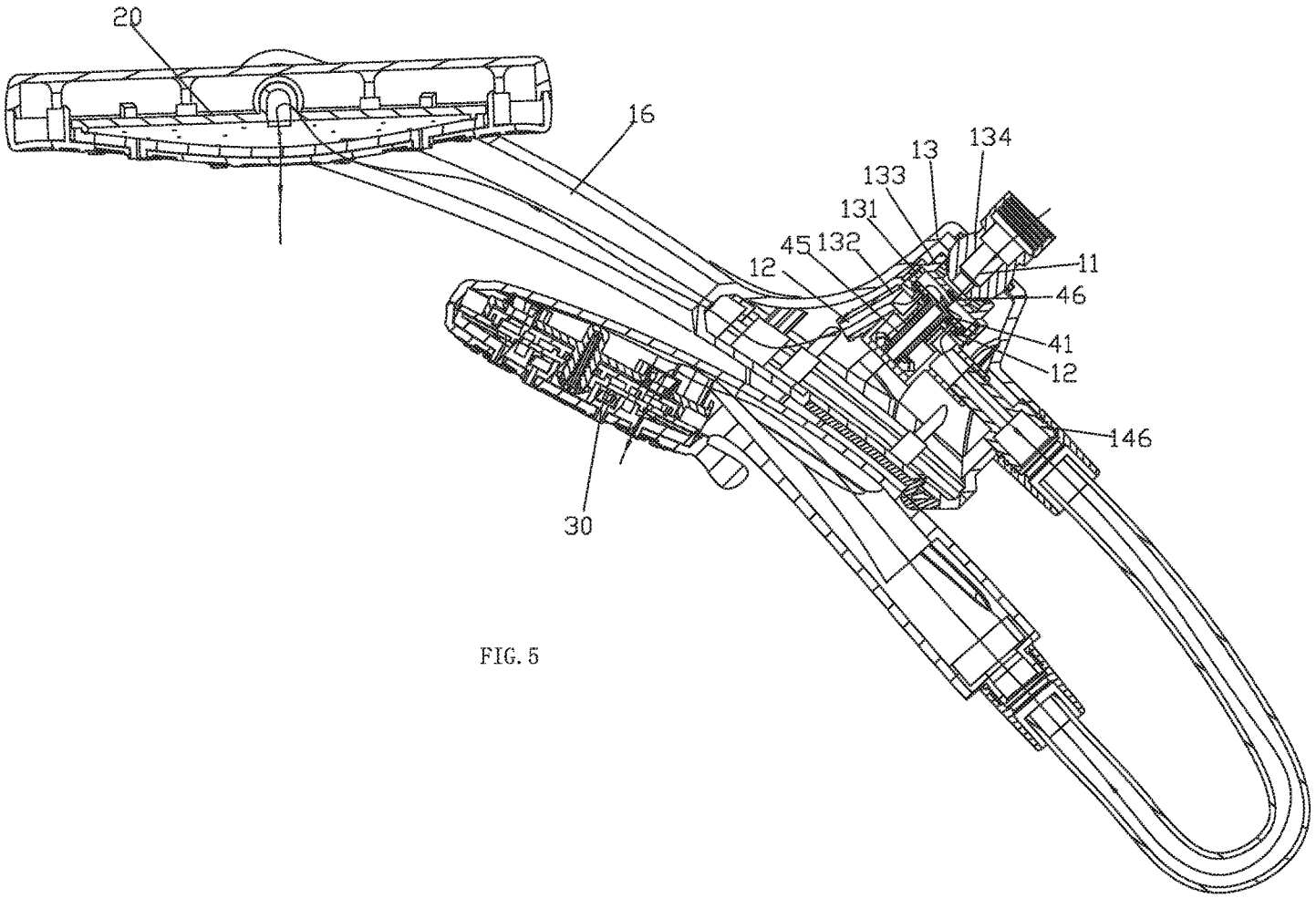
FIG. 5 illustrates a cross-section schematic diagram of the combination showerhead of a preferred embodiment under condition that water flows from both of the first showerhead and second showerhead.
Figure 6:
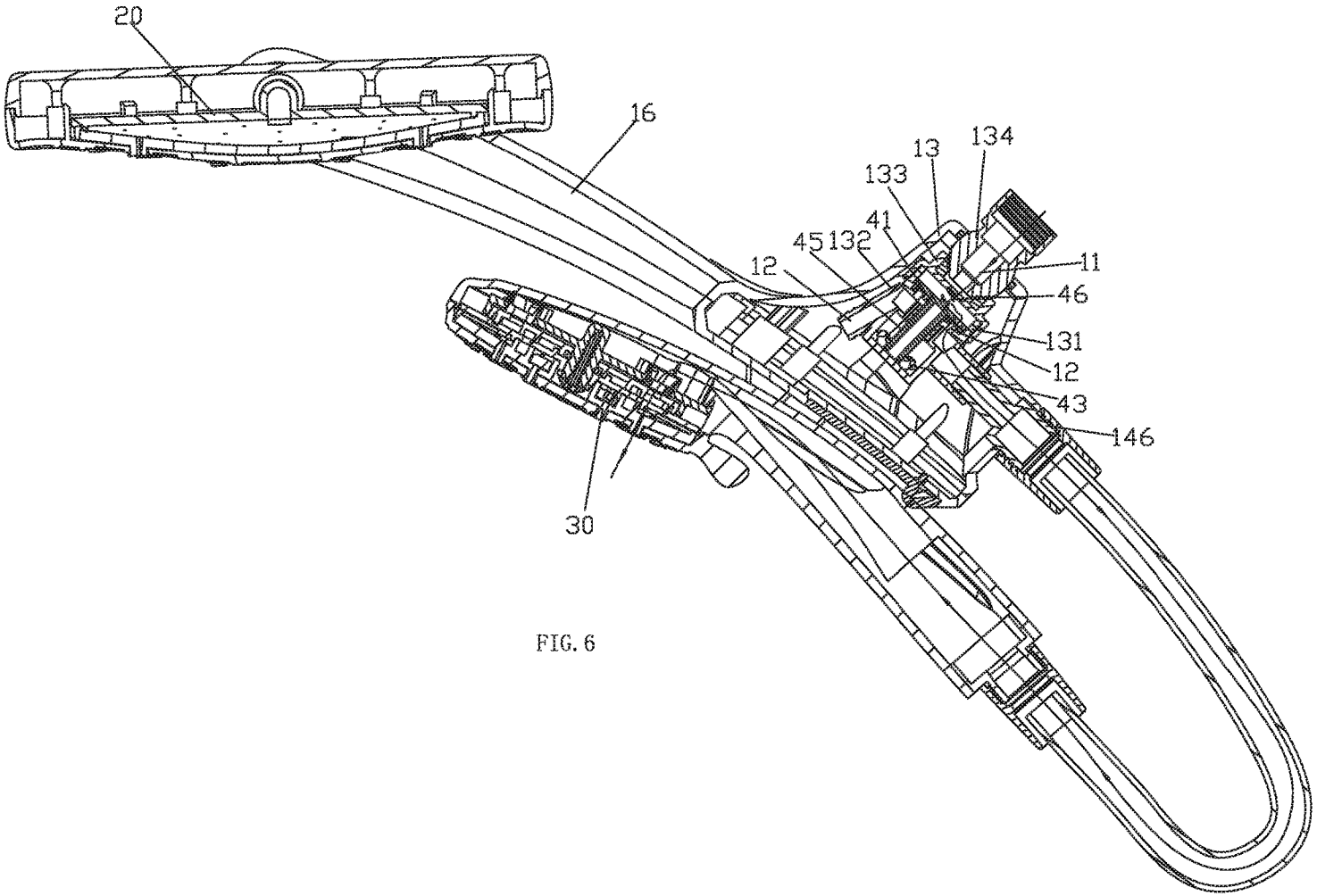
FIG. 6 illustrates a cross-section schematic diagram of the combination showerhead of a preferred embodiment under condition that water flows from the second showerhead.
Figure 7:
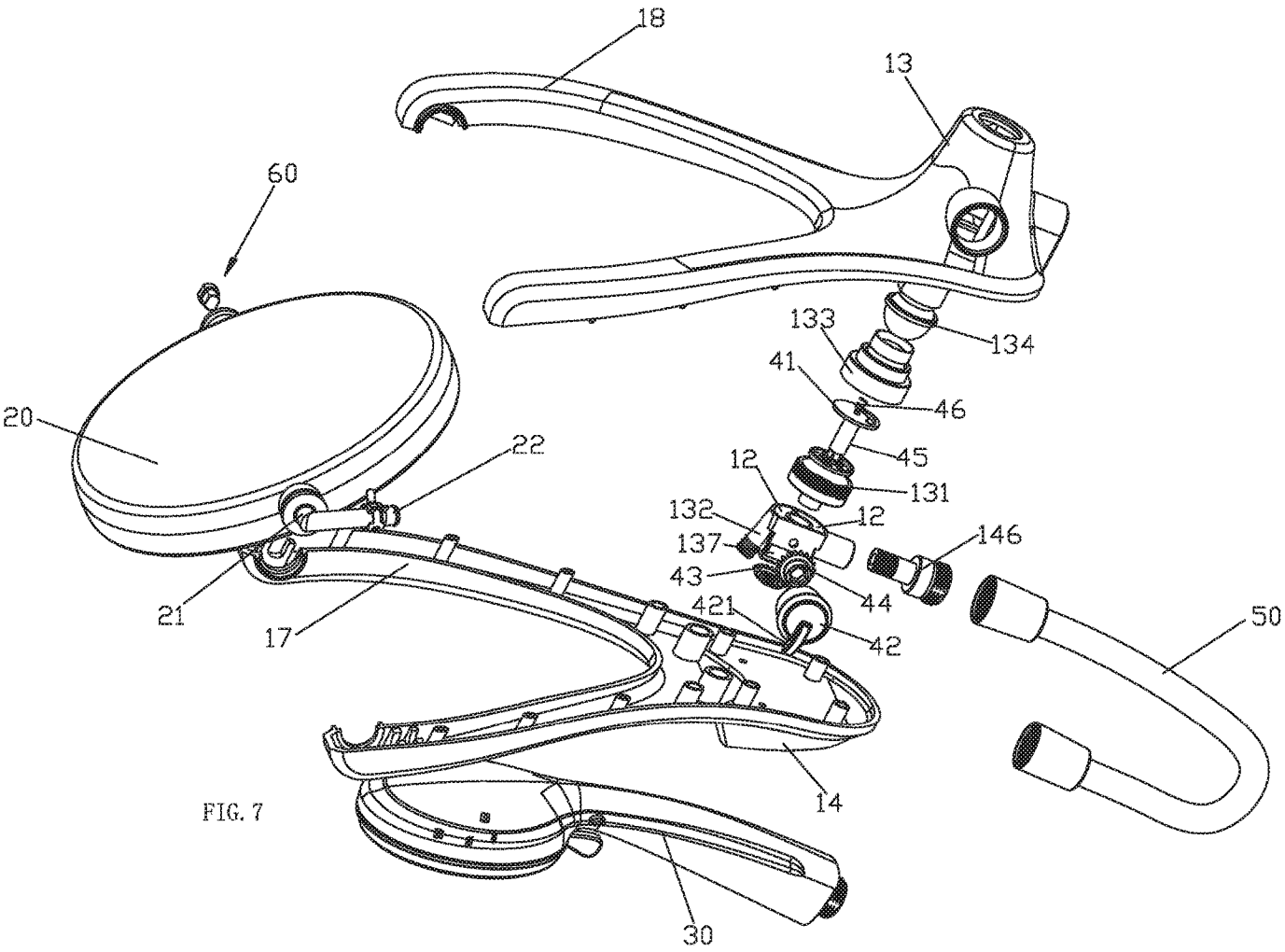
FIG. 7 illustrates an exploded perspective schematic diagram of the combination showerhead of a preferred embodiment.
Figure 9:
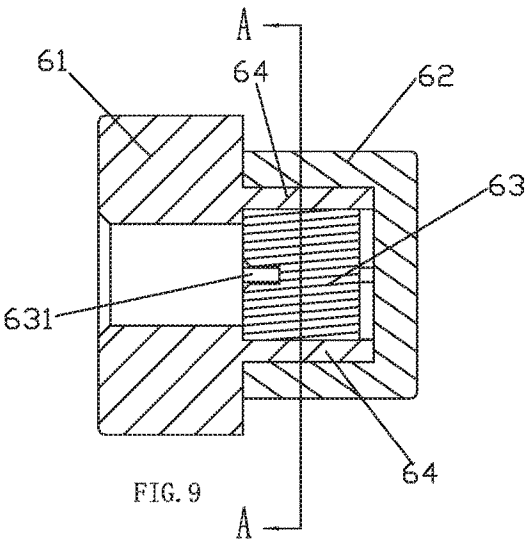
FIG. 9 illustrates a cross-section schematic diagram of the damping mechanism of a preferred embodiment.
Figure 8:
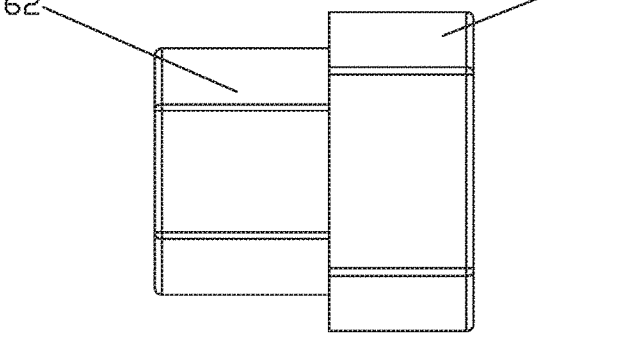
FIG. 8 illustrates a front view of the damping mechanism of a preferred embodiment.
Figure 10:
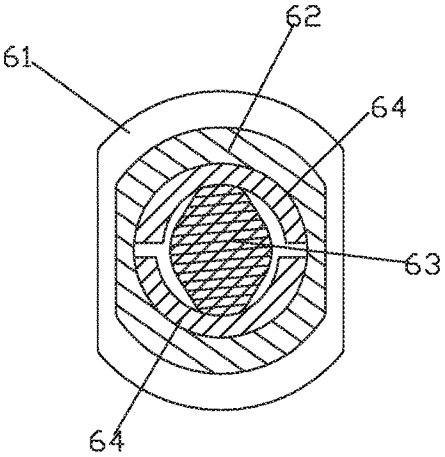
FIG. 10 illustrates an A-A cross-section schematic diagram of the damping mechanism of FIG. 9.

Combination showerhead with rotary button switching refers to FIG. 1 to FIG. 10 comprises fixing holder 10, first showerhead 20, second showerhead 30 and switching mechanism 40. Fixing holder 10 could be mounted to supporting arm which could be water supply pipe fixed on the wall and the connection could be permanent connection or universal connection coordinate with spherical structure. The first showerhead 20 could be top spray showerhead or head showerhead mounted to fixing holder 10. The first showerhead 10 could have one or more function for different water spray types. Fixing holder 10 comprises inlet passage 11 connected to supporting arm and at least two diversion passages 12.

One diversion passage 12 is connected to second showerhead 30;

Others are connected to first showerhead 20, wherein:

If the first showerhead 20 has one water spray function, the amount of diversion passages 12 is 2.

If the first showerhead 20 has more than one water spray function, the amount of other diversion passages 12 could be 1, and the switching of first showerhead and second showerhead is realized by switching mechanism 40 while switching of water spray function on the first showerhead 20 is realized by another switching mechanism which is additional; or the amount of other diversion passages 12 could be equal to the amount of function with one to one connection, and switching mechanism 40 is capable of switching the second showerhead 30 and functions of the first showerhead 20.

Fixing holder 10 has a common portion 15 and two forking portion 16 forking extend from common portion 15, and back of common portion 15 is convexly disposed with assembly portion 13. In this embodiment, fixing holder 10 comprises front cover 17 and back cover 18, first cover 17 and back cover 18 are fixed and connected to form common portion and forking portion described above. Through hole is disposed on back cover corresponding to common portion and the edge of through hole extends backwards to form assembly portion 13.

Switching mechanism 40 is mounted in assembly portion 13 for switching any of diversion passages to connect to inlet passage so as to realize switching of each diversion passage, or, switching of diversion passages and close up of all of diversion passages. Switching mechanism 40 comprises diversion plate 41, rotary button 42 and transmission mechanism. Diversion plate 41 is rotatably connected to fixing holder and cooperated with inlet passage 11 and diversion passages 12 to switching waterway. For example, diversion plate could have through hole and with alignment or separation of through hole and diversion passages to realize water connection or disconnection, or, diversion plate could be fan-shaped and cover diversion hole of diversion passage 12 completely or incompletely to realize water connection or disconnection. Rotary button 42 is rotatably connected to fixing holder 10 and rotation axis of rotary button 42 is perpendicular to rotation axis of diversion plate 41. Transmission mechanism comprises a first gear 43 connected to diversion plate 41 in transmission way and a second gear 44 connected to rotary button 42 in transmission way, and the first gear 43 and the second gear 44 are engaged.

Specifically, the assembly portion is disposed with through hole, front of rotary button 42 is convexly disposed with handle 421, back of rotary button 42 is fixedly disposed with fixing rod 422. Rotary button 42 is rotatably connected on through hole of fixing holder 10 so that handle 421 locates out of assembly portion 13 for user's poking. A shaft 45 is fixed below diversion plate. Both of the first gear 43 and the second gear 44 is bevel gear, the first gear 43 is fixed on lower end of shaft 45, the second gear 44 is fixed on inner end of fixing rod 422, and the first gear 43 and the second gear 44 are engaged. Elastomer 46 abuts against between diversion plate 41 and fixing holder 10 so that front surface of diversion plate 41 closely contacts fitting surface of fixing holder, and waterway switching is realized by relative rotation between diversion plate 41 and fitting surface of fixing holder. Fitting surface of fixing holder is disposed with diversion holes corresponding to diversion passages 12, diversion holes are switched with rotation of diversion plate and thereby switching of diversion passages is realized. There could be gasket disposed on fixing holder according to needs and gasket is disposed with through holes one to one corresponding to diversion holes, in this case, gasket forms the fitting surface.

In this embodiment, fixing holder further comprises fixing seat 131, diversion body 132 and connecting seat 133 disposed in assembly portion. Diversion cavity is formed between connecting seat 133 and fixing seat 131 which form part of inlet passage 11. Diversion plate 41 is rotatably connected on fixing seat 131, and the surface of fixing seat 131 corresponding to diversion cavity is supposed to be the fitting surface. Elastomer 46, such as spring, is configured between diversion plate and connecting seat 133 so that diversion plate 41 abuts against the fitting surface of fixing seat 131 and sealed. Fixing seat 131 is disposed with at least two diversion holes to form part of diversion passages 12 respectively, and with rotating of diversion plate, different diversion holes connecting to diversion cavity is realized, so that switching of different diversion passages connecting to inlet passage 11 is realized. Diversion body 132 is mounted to fixing seat 131 and comprises at least two water passages which connecting to diversion holes respectively and form part of diversion passages 12. Fixing seat 131 is disposed with assembly hole 135, sides of assembly hole extends downward to form column; the diversion cavity is concavely disposed with assembly groove 136 with smaller opening and bigger interior and side face of diversion cavity is further concavely disposed with mouth 137 connected to interior of assembly groove 136. The column inserts into opening of assembly groove 136 in adaptation. The shaft pass through the assembly hole with end inserts deeply into interior of assembly groove 136. The first gear is placed into interior of assembly groove 136 through mouth 137. Shaft and the first gear is configured in interior of assembly groove 136, and thereby diversion plate is easy to be assembled and disassembled coordinated with elastomer. Connecting seat 133 is mounted to supporting arm via ball joint 134.

The first showerhead 20 is rotatably connected between two forking portion 16. A hose piece 21 disposed along the rotation axis of the first showerhead 20 is connected to the first showerhead 20 and a tube 22 is disposed on the other end. The hose piece 21 and tube 22 forms L-shape, and other diversion passages 12 are disposed along hose piece 21 and tube 22 to connect to the first showerhead. If there is only one diversion passage 12, then hose piece 21 and tube 22 could be part of diversion passage.

A damping mechanism 60 is disposed between forking portion 16 of fixing holder 10 and the first showerhead 20, which comprises locating holder 61, turning block 62 and cam 63. Locating holder 61 comprises a base and two dangling pieces 64 disposed separately in circumferential direction of locating holder 61 which forms a rotary sleeve-like structure as lancing forms between two dangling pieces 64. Outer wall of rotary sleeve-like structure is rotative surface, while inner wall is radii changing and forms radii changing part, cam 63 is disposed in the rotary sleeve to match the radii changing part; turning block 62 is sleeved on the rotary sleeve, friction force of dangling pieces 64 and turning block 62 changes with rotation of the cam 63 relative to the radii changing part and thereby the damping changes. In a preferred situation, the base is perforative so that one end surface of cam 63 is exposed and disposed with matching groove 631 for driving cam to rotate by users.

In one embodiment, the second showerhead 30 is handle showerhead. Front lower part of common portion 15 is disposed with a connecting portion 14 for handle showerhead positioning. Connecting portion could, but not limited, be a plug base or magnetic structure. The diversion passage 12 connected to the second showerhead 30 further comprises a connector 146 to connect one water passage of the diversion body, and end opening of connector 146 forms water outlet. The connector could pass through assembly portion 13, and the handle showerhead is connected to outlet of corresponding diversion passage 12 via a hose 50.

Figure 11:
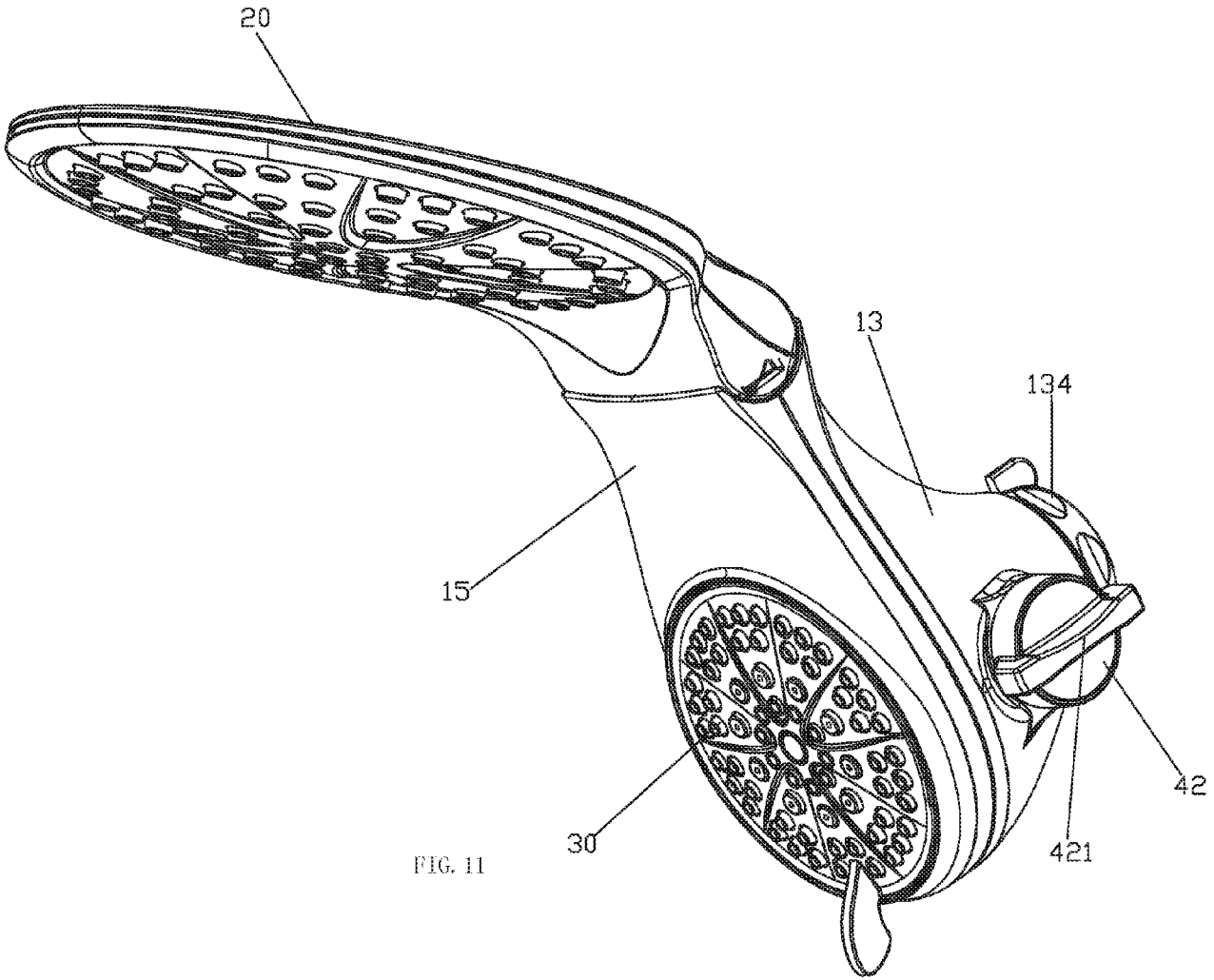
FIG. 11 illustrates a perspective schematic diagram of the combination showerhead of another preferred embodiment.
Figure 12:
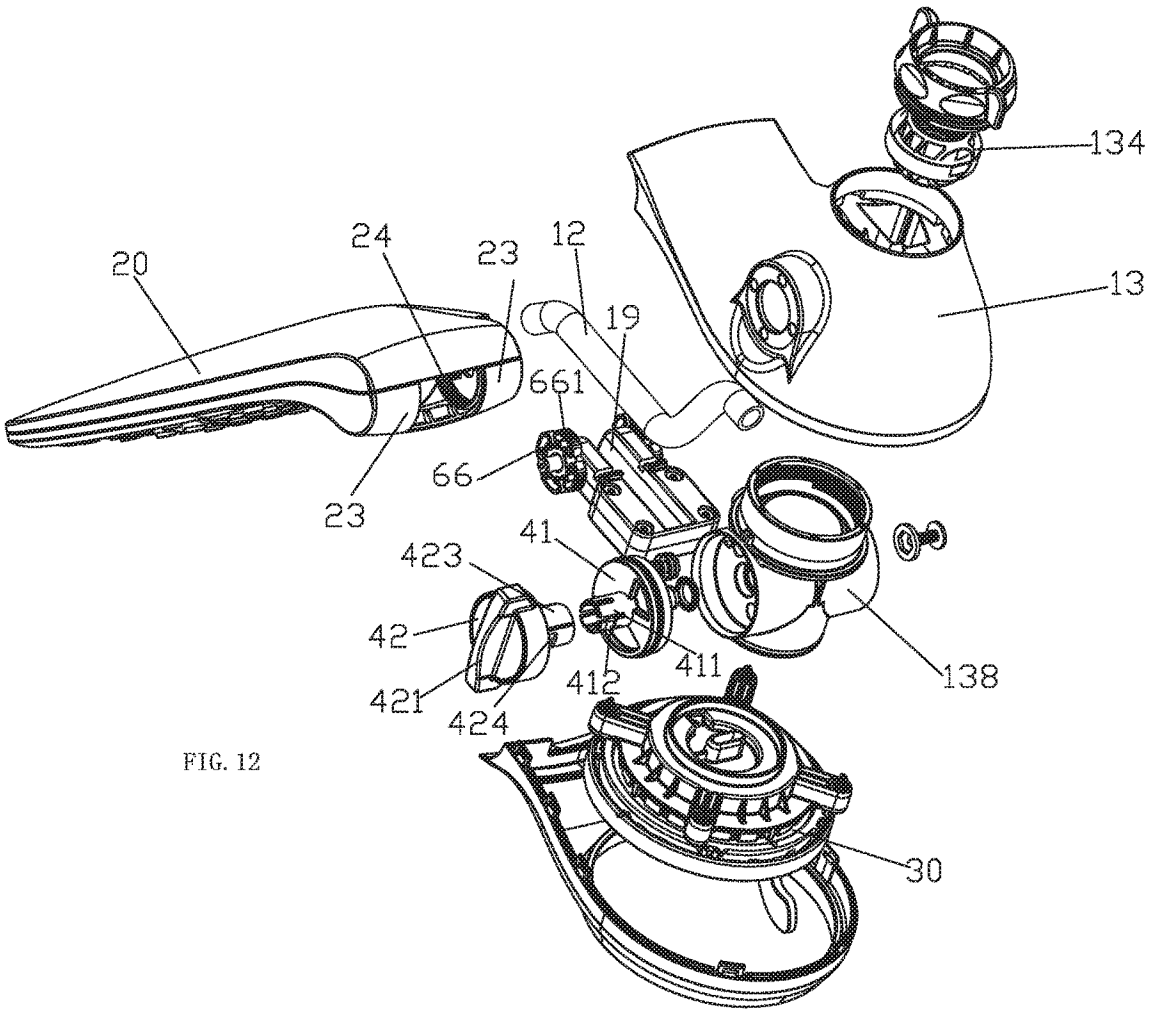
FIG. 12 illustrates an exploded perspective schematic diagram of the combination showerhead of another preferred embodiment.
Figure 13:
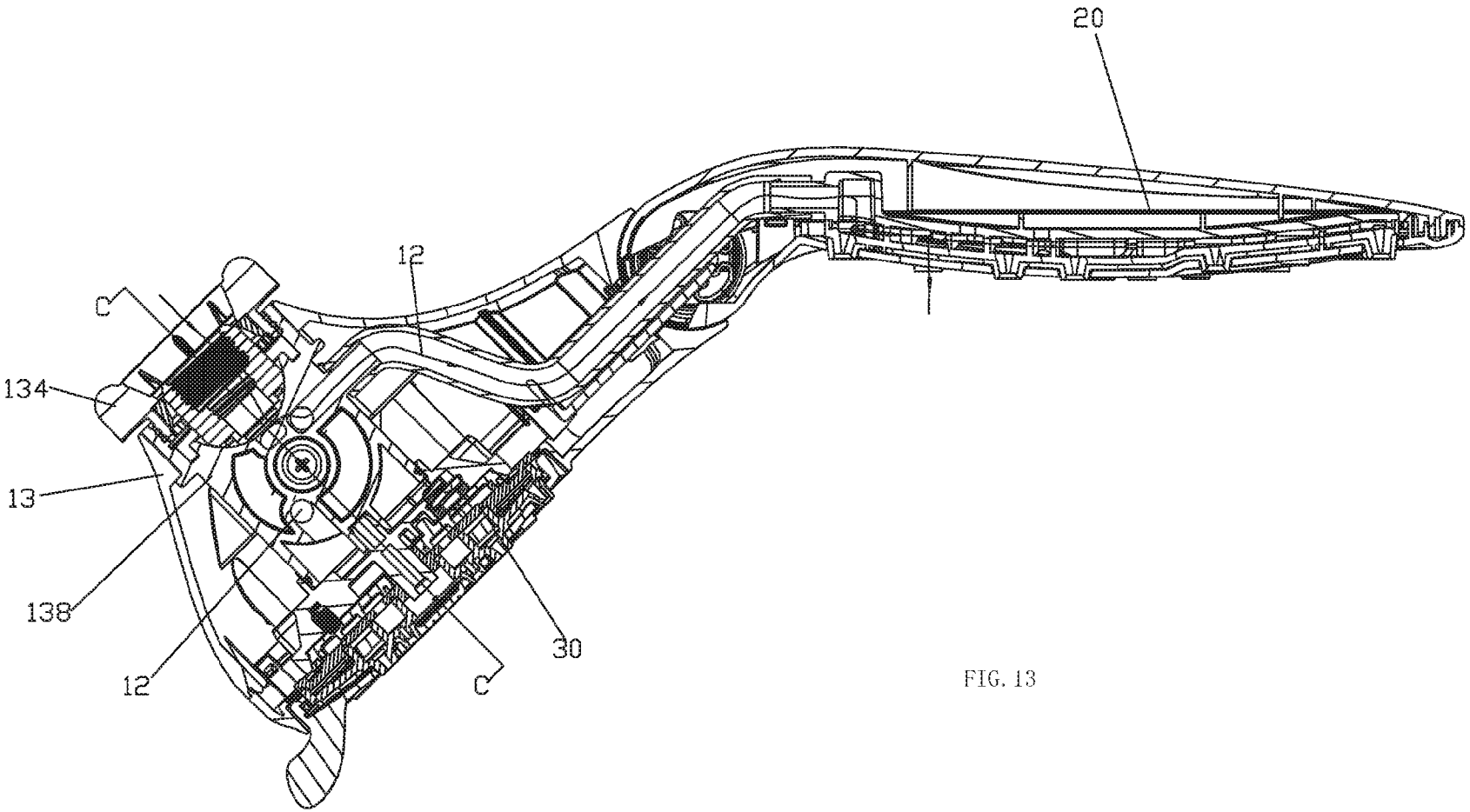
FIG. 13 illustrates a cross-section schematic diagram of the combination showerhead of another preferred embodiment.
Figure 15:
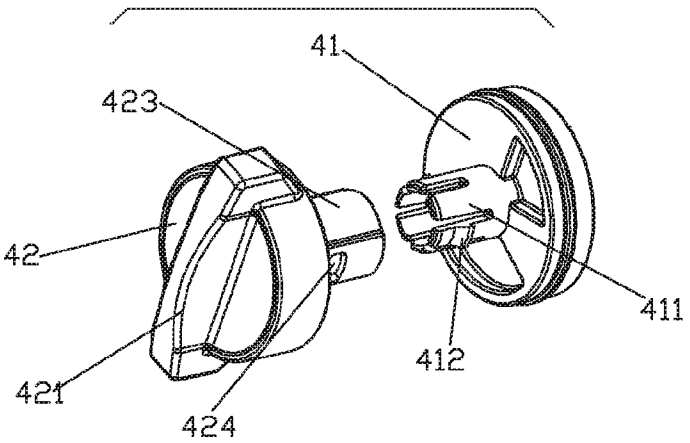
FIG. 15 illustrates a schematic diagram of the interoperation of rotary button and diversion plate of another preferred embodiment.
Figure 14:
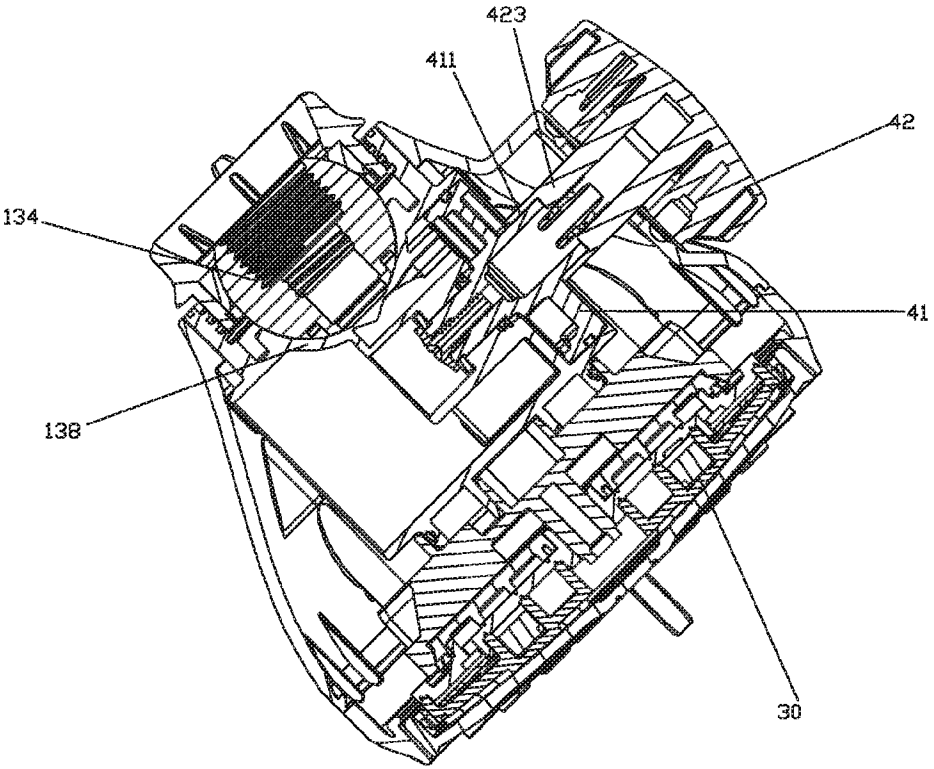
FIG. 14 illustrates a C-C cross-section schematic diagram of FIG. 13.
Figure 16:
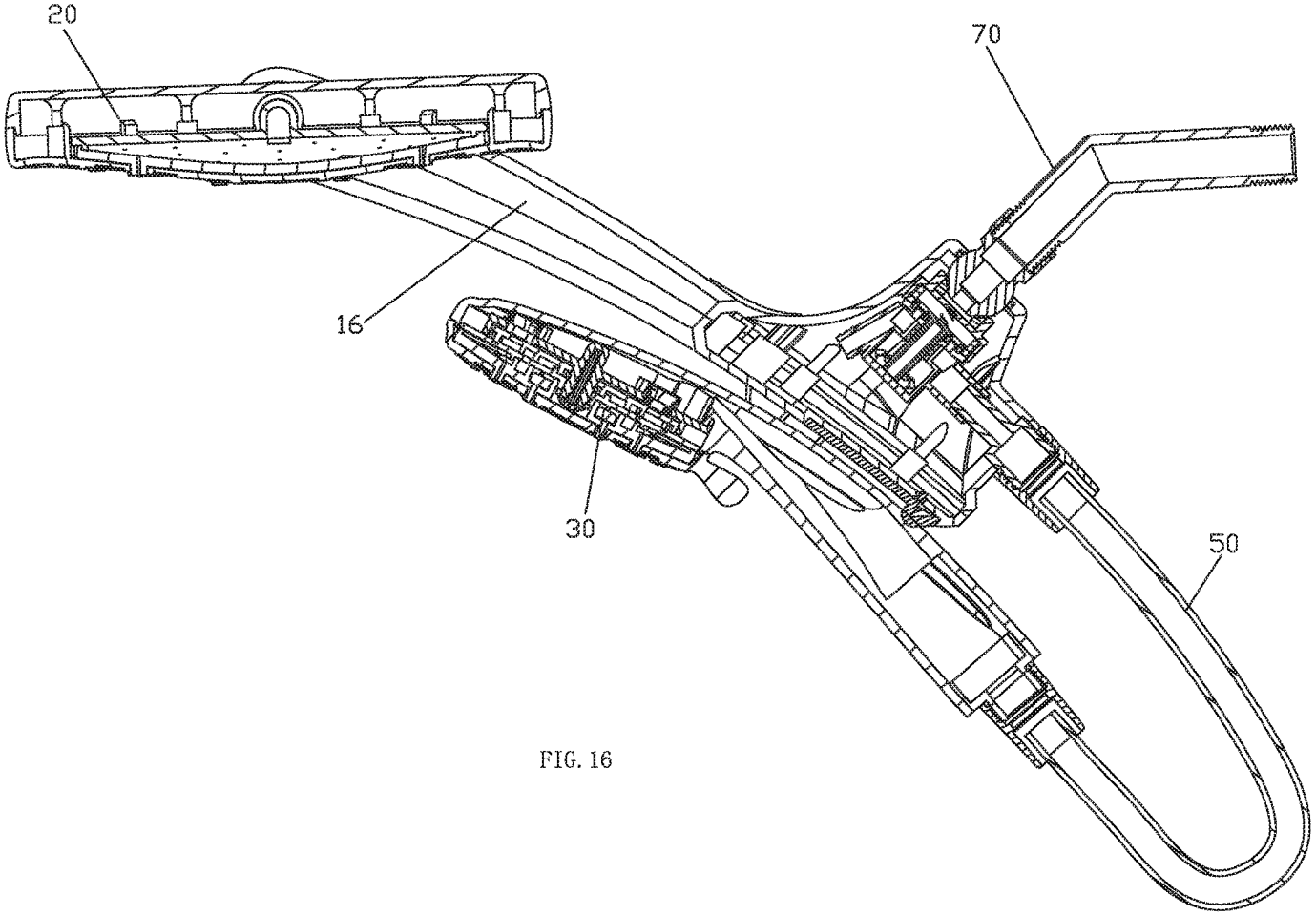
FIG. 16 illustrates a cross-section schematic diagram of the combination showerhead of a FIG. 1 mounted to a supporting arm

In another preferred embodiment as shown in FIG. 11 to FIG. 15, the different comparing to above embodiment is that: the second showerhead 30 is fixed showerhead fixed on the front lower part of the common portion of fixing holder 10, and water passage of the diversion body connects to fixed showerhead directly. The common portion is convexly disposed with a convex part 19, and the first showerhead is convexly disposed with two convex lugs 23. Convex part 19 is configured between two convex lugs and the first showerhead is connected to convex part via pivot. The pivot is hollow for the other diversion passages passing through to connect to the first showerhead. The damping mechanism is configured between the convex part and the convex lugs, which comprises a connecting part 66 disposed on convex part 19. There could be one connecting part 66 having cylindrical surface, or more than one connecting parts 66 arrange in circumferential direction separately with each one has cylindrical surface. The cylindrical surface is convexly disposed with damping teeth 661. Convex lug 23 is concavely disposed with groove 24 which sleeve-connecting to the connecting part. Inner wall of groove 24 is also convexly disposed with damping teeth 221 separately mating damping teeth 661 to realize damping.

Front face of the diversion plate 41 is convexly disposed with a connecting column 411, the rotary button 42 is convexly disposed with a connecting seat 423, and the connecting column 411 and the connecting seat 423 are in demountable connection. Connecting mechanism is disposed to rotate diversion plate 41 to fixing holder and so that rotary button, diversion plate and fixing holder could be connected together and diversion plate together with rotary button could rotate relative to fixing holder. In this embodiment, fixing holder further comprises assembly seat 138 fixed in the assembly portion and mounted to supporting arm via ball joint 134. The connecting mechanism comprises supporting board connected on back of assembly seat and screw pass through supporting board and screwed on diversion plate.

Connecting column 411 is disposed with several dangling arms and outer wall of dangling arm is convexly disposed with snap 412. Connecting seat 423 is a sleeve and disposed with slot 424. Connecting column 411 inserts into connecting seat 423 and snap 412 inserts into slot 424, and thereby the two components are capable of connecting together in removable way.

Although the present invention has been described with reference to the preferred embodiments thereof for carrying out the patent for invention, it is apparent to those skilled in the art that a variety of modifications and changes may be made without departing from the scope of the patent for invention which is intended to be defined by the appended claims.

What is claimed is:

1. A combination showerhead with rotary button switching, comprising:

a fixing holder that is mounted to a supporting arm and that comprises an inlet passage connected to the supporting arm and at least two diversion passages;

a first showerhead that is mounted to the fixing holder and that is connected to at least one diversion passage of the at least two diversion passages;

a second showerhead that is connected to another diversion passage of the at least two diversion passages; and a switching mechanism that comprises:

a diversion plate configured to rotatably connect to the fixing holder and to cooperate with the inlet passage and the at least two diversion passages to switch waterways;

a rotary button configured to rotatably connect to the fixing holder for a user to operate to switch waterways; and a transmission mechanism that is connected between the diversion plate and the rotary button to control position of the diversion plate in response to position of the rotary button, and that comprises a first gear connected to the diversion plate and a second gear connected to the rotary button, the first gear and the second gear being engaged with one another.

2. The combination showerhead with rotary button switching according to claim 1, wherein the diversion plate and the rotary button each have a rotation axis, wherein both the first gear and the second gear are bevel gears, and wherein the rotation axis of the diversion plate and the rotation axis of the rotary button intersect each other.

3. The combination showerhead with rotary button switching according to claim 1, wherein the switching mechanism further comprises:

an elastomer part that abuts against and is positioned between the diversion plate and the fixing holder;

a shaft that is fixed below the diversion plate and to which the first gear is fixed;

a fixing rod that is fixed on an internal portion of the rotary button and to which the second gear is fixed.

4. The combination showerhead with rotary button switching according to claim 1, wherein an inward portion of the fixing holder is convexly disposed with an assembly portion and the switching mechanism is disposed inside the assembly portion with at least a part of the rotary button extending outside of the assembly portion for a user to operate to switch waterway.

5. The combination showerhead with rotary button switching according to claim 4, wherein the second showerhead is a hand held showerhead, the another diversion passage of the at least two diversion passages has an outlet connected to the second showerhead that is disposed on a sidewall of the assembly portion, and the hand held showerhead is connected to a corresponding outlet through a flexible hose, and wherein the fixing holder has a front lower part disposed with a connecting portion for positioning the hand held showerhead.

6. The combination showerhead with rotary button switching according to claim 4, wherein the fixing holder has a common portion and two forking portions that forking extend from the common portion, wherein the first showerhead is rotatably connected between the two forking portions, a hose piece is disposed along a rotation axis of the first showerhead and part of the at least one diversion passage of the at least two diversion passages is connected to the first showerhead along the hose piece.

7. The combination showerhead with rotary button switching according to claim 6, wherein the assembly portion is attached to the common portion.

8. The combination showerhead with rotary button switching according to claim 6, wherein a damping mechanism is disposed between one forking portion of the fixing holder and the first showerhead.

9. The combination showerhead with rotary button switching according to claim 8, wherein the damping mechanism comprises a locating holder; a turning block; and a cam, wherein at least two dangling pieces are disposed separately in a circumferential direction on the locating holder to form a rotary sleeve-like structure with at least a part of an inner wall thereof having a changing radii, wherein the cam is disposed in the rotary sleeve-like structure to match the changing radii of the at least a part of the inner wall, wherein the turning block is sleeved on the rotary sleeve-like structure, and wherein the dangling pieces and the turning block have a frictional force there between that changes with rotation of the cam relative to the changing radii of the at least a part of the inner wall to change a damping characteristic.

10. The combination showerhead with rotary button switching according to claim 4, wherein the first showerhead has a rotation axis, wherein the fixing holder has a common portion and the first showerhead is rotatably connected to the common portion; and wherein at least a hose piece is disposed along the rotation axis of the first showerhead and part of the at least one diversion passage of the at least two diversion passages is connected to the first showerhead along the hose piece.

* * * * *